US006912843B2

(12) United States Patent
Hufendiek et al.

(10) Patent No.: US 6,912,843 B2
(45) Date of Patent: Jul. 5, 2005

(54) EXHAUST SYSTEM FOR A MULTI-CYLINDER INTERNAL COMBUSTION ENGINE

(75) Inventors: Jochen Hufendiek, Stuttgart (DE); Sascha Rossa, Baltmannsweiler (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 10/754,637

(22) Filed: Jan. 12, 2004

(65) Prior Publication Data

US 2004/0194457 A1 Oct. 7, 2004

(30) Foreign Application Priority Data

Jan. 11, 2003 (DE) ..... 103 00 773

(51) Int. Cl.[7] ..... F01N 3/00

(52) U.S. Cl. ..... 60/282; 60/322; 60/323; 60/324

(58) Field of Search ..... 60/282, 312, 313, 60/322, 323, 324

(56) References Cited

U.S. PATENT DOCUMENTS 3,921,395 A * 11/1975 Kawata ..... 60/282
4,133,174 A * 1/1979 Masaki ..... 60/285
4,172,362 A * 10/1979 Mizuno et al. ..... 60/278
5,351,481 A 10/1994 Flugger
5,519,994 A * 5/1996 Hill ..... 60/313

* cited by examiner

*Primary Examiner*—Thomas Denion
*Assistant Examiner*—Diem Tran
(74) *Attorney, Agent, or Firm*—Crowell & Moring LLP

(57) ABSTRACT

An exhaust system of a multi-cylinder internal combustion engine, particularly in a motor vehicle, has a first exhaust-gas line for receiving the exhaust gas from a first cylinder group of the internal combustion engine, a second exhaust-gas line for receiving the exhaust gas from a second cylinder group of the internal combustion engine, an exhaust-gas expansion chamber and an exhaust-gas outlet line, leading out of the exhaust-gas expansion chamber. The first and second exhaust-gas lines lead into an exhaust-gas mixing chamber which is coupled in gas flow communication with the exhaust-gas expansion chamber, so that exhaust gas can expand via the perforation of the exhaust-gas mixing chamber, into the exhaust gas expansion chamber.

13 Claims, 4 Drawing Sheets

EXHAUST SYSTEM FOR A MULTI-CYLINDER INTERNAL COMBUSTION ENGINE

BACKGROUND AND SUMMARY OF THE INVENTION

This application claims the priority of German patent document 103 00 773.3, filed Jan. 11, 2003, the disclosure of which is expressly incorporated by reference herein.

The invention relates to an exhaust system of a multi-cylinder internal combustion engine.

U.S. Pat. No. 5,351,481 discloses an exhaust system of a multi-cylinder internal combustion engine, in which the exhaust gas from two cylinder groups of the internal combustion engine is received by a respective exhaust-gas line that terminates with its open end in an exhaust-gas expansion chamber. An exhaust-gas outlet line leading out of the exhaust-gas expansion chamber terminates in each case at a short distance from the open end of each of the exhaust-gas lines. This exhaust system is intended to achieve both sound insulation and an improvement in performance of the internal combustion engine.

One object of the invention is to provide an exhaust system of a multi-cylinder internal combustion engine, which permits improved noise emission and power output of the internal combustion engine.

This and other objects and advantages are achieved by the exhaust system according to the invention, in which the first and second exhaust-gas lines are lead into an at least partially perforated exhaust-gas mixing chamber. The exhaust-gas mixing chamber is coupled in gas flow communication with an exhaust gas expansion chamber, so that exhaust gas can expand out of the exhaust-gas mixing chamber into the exhaust-gas expansion chamber, via the perforation of the exhaust-gas mixing chamber.

The cylinder groups to which the exhaust-gas lines are connected in each case may be formed by any desired cylinders of a multi-cylinder internal combustion engine. However, the exhaust system according to the invention is suitable, in particular, for an internal combustion engine designed as a V-engine with two cylinder banks. In this case, the cylinder groups are formed by the two cylinder banks. Preferably, each of the exhaust-gas lines is connected via an associated exhaust-gas manifold to one cylinder group and receives the exhaust gas from the cylinder group. The exhaust-gas streams of the cylinder groups are discharged separately from the exhaust-gas lines and are combined in the exhaust-gas mixing chamber.

The exhaust-gas expansion chamber is in this case designed as a housing which is outwardly substantially gas-tight. Together with the exhaust-gas mixing chamber, it forms an arrangement in which the exhaust gases emerging from the exhaust-gas mixing chamber via the perforation can be received completely.

The exhaust-gas mixing chamber may be designed as a line element of any desired form, in which the exhaust-gas streams are combined and the outer surface area of which has a perforation preferably along a defined portion. The perforation may be designed as an orifice of any desired form, but it is preferably formed by a multiplicity of identical orifices arranged uniformly on the portion and is implemented, for example, by round orifices with a diameter of about 5 mm. Preferably, the first and the second exhaust-gas line are closed off by means of the exhaust-gas mixing chamber, so that the exhaust-gas mixing chamber forms, as it were, a short circuit with respect to the first and the second exhaust-gas line.

The exhaust-gas mixing chamber is flow-connected to the exhaust-gas expansion chamber via the perforation. The exhaust-gas streams conducted out of the exhaust-gas lines into the exhaust-gas mixing chamber meet one another in the exhaust-gas mixing chamber, are intermixed and can flow over into the exhaust-gas expansion chamber via the perforation acting as overflow orifices. As a result, noise emission is reduced.

By means of special structural embodiments, the acoustic pattern can be influenced in a controlled manner, preferably in the form of a sound-insulating action. The discharge of the exhaust gases from the exhaust-gas expansion chamber takes place via the exhaust-gas outlet line leading out of the exhaust-gas expansion chamber.

The exhaust-gas outlet line is designed as a pipeline which, open on the end face, issues into the exhaust-gas expansion chamber. Preferably, the exhaust-gas outlet line is formed by two separate pipelines. These are preferably led out of the exhaust-gas expansion chamber next to one another.

The exhaust-gas mixing chamber according to the invention acts, as it were, as a short circuit with respect to the exhaust-gas streams delivered via the first and the second exhaust-gas line. The length of the exhaust-gas lines and the perforated portion of the exhaust-gas mixing chamber are preferably defined in such a way that an interference of the gas oscillations occurs when the two exhaust-gas streams meet in the exhaust-gas mixing chamber. This helps to optimize the torque delivered by the internal combustion engine, while at the same time achieving improved noise emission, preferably sound insulation. In particular, due to the suitably defined flow-active distance of the exhaust-gas mixing chamber from the outlet valve of the engine, a gas-dynamic benefit having an effect on the engine torque can be achieved, since pressure waves and suction waves in the exhaust-gas lines can advantageously interact with one another. These gas-dynamic benefits can be enhanced by a suitable selection of valve control times. Moreover, the design according to the invention achieves good intermixing of the exhaust-gas streams meeting one another in the exhaust-gas mixing chamber, favorably affecting the acoustics, particularly with regard to the engine secondary orders, even in the case of a limited construction space.

In one embodiment of the invention, the exhaust-gas mixing chamber is arranged directly adjacent to the exhaust-gas expansion chamber, so that a direct overflow and expansion of exhaust gas via the perforation of the exhaust-gas mixing chamber into the exhaust-gas expansion chamber is possible.

Preferably, the exhaust-gas mixing chamber and the exhaust-gas expansion chamber are designed to rest against one another, and the exhaust-gas expansion chamber has, in the region of contact, one or more orifices which overlap the perforation of the exhaust-gas mixing chamber. The exhaust-gas mixing chamber and the exhaust-gas expansion chamber may, however, also have a perforated common partition, via which the overflow and, if appropriate, expansion of exhaust gas can take place.

In a further embodiment of the invention, the exhaust-gas mixing chamber is arranged in the exhaust-gas expansion chamber, which achieves a compact and space-saving arrangement. Preferably, the exhaust-gas lines issuing into the exhaust-gas mixing chamber lead through the exhaust-gas expansion chamber wall and the exhaust-gas streams are combined in the exhaust-gas mixing chamber. In the region where the exhaust gases are combined, therefore, the exhaust system has a double casing, so that especially good sound insulation can be achieved.

In a further embodiment of the invention, the exhaust-gas mixing chamber is designed as a connecting line by which the first exhaust-gas line and the second exhaust-gas line are combined. Preferably, the connecting line is designed as a simple pipeline which acts as a short-circuit line with respect to the first and the second exhaust-gas line. This design permits a structurally simple and effective control of the exhaust-gas acoustics.

In a further embodiment of the invention, the exhaust-gas mixing chamber has a perforation made uniformly all-round. If a pipeline is arranged as an exhaust-gas mixing chamber in the exhaust-gas expansion chamber, the pipeline has one or more portions perforated uniformly all-round. It is thus possible to have a radially uniform overflow of exhaust gas into the exhaust-gas expansion chamber, and to influence noise emission positively.

In a further embodiment of the invention, the exhaust-gas outlet line has a portion branching off from the first exhaust-gas line and/or from the second exhaust-gas line upstream of the exhaust-gas mixing chamber. The portions of the exhaust-gas outlet line which branch off from the exhaust-gas lines are combined, outside the exhaust-gas expansion chamber, with the portions of the exhaust-gas outlet line which lead out of the exhaust-gas expansion chamber. In a particularly preferred embodiment, the exhaust-gas outlet line is of double-flow design, and each of the flows has a branch-off from an exhaust-gas line, with the branch-off being arranged within the exhaust-gas expansion chamber. In this case, the exhaust-gas mixing chamber is also arranged in the exhaust-gas expansion chamber. In addition, each of the exhaust-gas outlet flows has a portion led into the exhaust-gas expansion chamber, with an open end for the discharge of exhaust gas from the exhaust-gas expansion chamber. The portion branching off from the exhaust-gas line is combined, outside the exhaust-gas expansion chamber, with the portion leading out of the exhaust-gas expansion chamber. This arrangement helps to achieve an especially effective control of the acoustics, particularly in terms of the engine secondary orders.

In a further embodiment of the invention, the first exhaust-gas line and/or the second exhaust-gas line, the exhaust-gas outlet line has a perforated portion led through a housing outside the exhaust-gas expansion chamber. An additional expansion of the exhaust gas due to emergence from the exhaust-gas line can occur in this housing. This embodiment therefore serves mainly for further sound insulation.

Preferably, both the first and the second exhaust-gas line have such a perforated line portion in a specific housing assigned to them in each case. The respective housings may be separate from one another. Preferably, however, they are designed to lie next to one another with a common partition. In a particularly preferred design, the exhaust-gas mixing chamber is arranged within the exhaust-gas expansion chamber and the housing or housings is or are contiguous, on the end face, to the exhaust-gas expansion chamber, thus resulting in a common partition with the exhaust-gas expansion chamber. This makes it possible to have a material-saving and compact arrangement.

In a further embodiment of the invention, means are provided for closing a predeterminable part of the perforation of the exhaust-gas mixing chamber. When the exhaust-gas mixing chamber is of tubular design, the closing means may be, for example, a sleeve which is displaceable so as to rest against the wall on the inside or on the outside. As a result of such displacement, a variable and predeterminable part of the perforation can be closed or opened, as required. Preferably, closing is executed in such a way that a perforation part predetermined as a function of the operating state of the internal combustion engine can be closed or opened.

The invention advantageously makes it possible to influence the noise and to influence the torque as a function of the driving state of the associated vehicle.

Other objects, advantages and novel features of the present invention will become apparent from the following detailed description of the invention when considered in conjunction with the accompanying drawings.

DETAILED DESCRIPTION OF THE DRAWINGS

Figure 1:
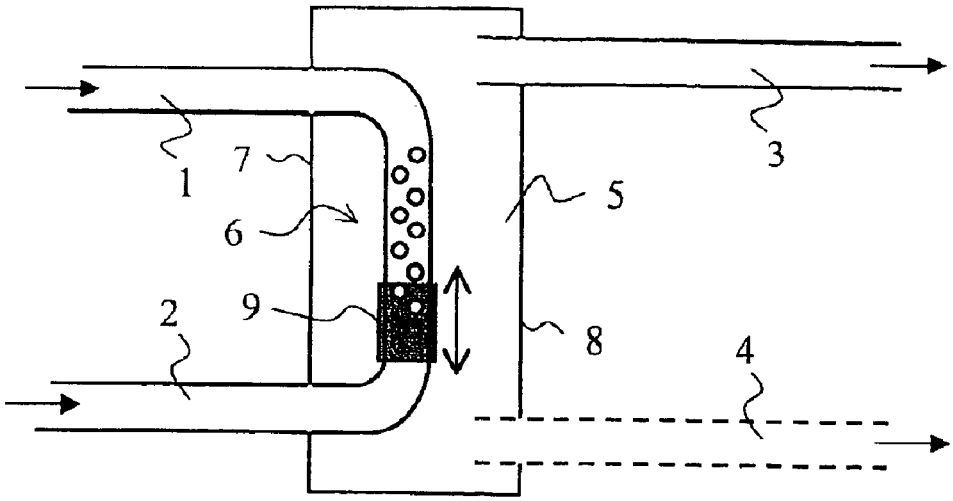
FIG. 1 is a diagram that illustrates an embodiment of the exhaust system according to the invention.

FIG. 1 shows a preferred embodiment of the exhaust system according to the invention, having an exhaust-gas expansion chamber 5 that is approximately parallelepipedic. Running next to one another and in parallel, first and second exhaust-gas lines 1,2 are led through a side wall 7 into the exhaust-gas expansion chamber 5. An exhaust-gas outlet line consisting of two separate pipelines 3, 4 is lead through the opposite side wall 8 out of the exhaust-gas expansion chamber 5. The pipeline 4 is optional, and is illustrated by the broken lines. The exhaust-gas lines 1, 2 are part of a double-flow exhaust system and lead to a first and a second cylinder bank of a V-engine, (not shown).

The first exhaust-gas line 1 and the second exhaust-gas line 2 are connected to one another in the exhaust-gas expansion chamber 5 via an exhaust-gas mixing chamber 6, which is in the form of a pipeline bend with a perforated straight middle part. The pipeline bend constitutes a connecting line of the first exhaust-gas line 1 and second exhaust-gas line 2, in which the exhaust-gas streams of the exhaust-gas flows are combined. The perforation is preferably formed by holes arranged uniformly all-round and having a diameter of 1 mm to 10 mm (particularly preferably of 2 mm to 7 mm). As a result, a uniform expansion of the exhaust gases, combined in the exhaust-gas mixing chamber 6, of the exhaust-gas flows into the exhaust-gas expansion chamber 5 becomes possible. Moreover, the exhaust-gas mixing chamber 6 is provided with a displaceable and/or rotatable sleeve 9. (The displacibility is in this case marked by a double arrow.) A freely selectable region of the perforation can thereby be covered or exposed.

In the arrangement illustrated in FIG. 1, the exhaust-gas streams (symbolized by direction arrows) of the first exhaust-gas line 1 and of the second exhaust-gas line 2 are deflected at 90° and meet one another approximately frontally in the exhaust-gas mixing chamber 6. The pressure waves in the exhaust-gas lines 1, 2 interfere in this case, influencing both torque and noise generation. By adjustment of the sleeve 9, part of the perforation of the exhaust-gas mixing chamber 6 can be closed, as required. The adjustment of the sleeve is performed by a mechanism (not illustrated in any more detail), as a function of the operating point, and preferably the rotational speed, of the internal combustion engine. As a result, the gas-dynamic effect occurring due to the perforation can be varied, and the acoustics can be influenced according as necessary.

Figure 2:
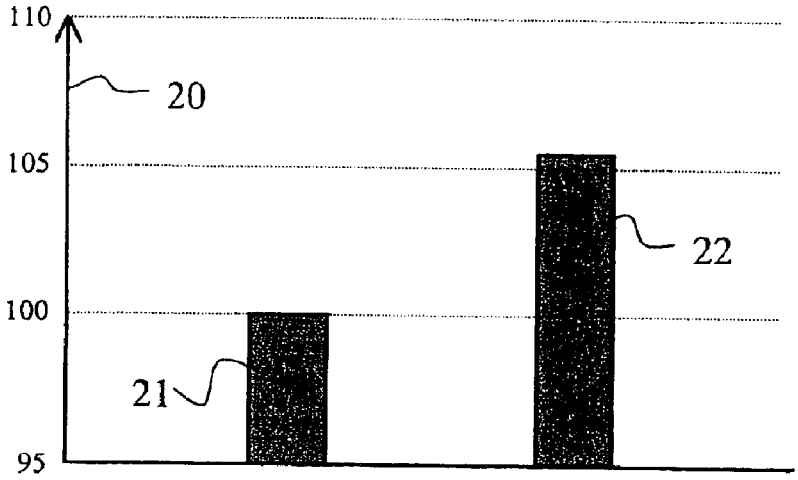
FIG. 2 is a bar chart which shows the dependence of the torque of an internal combustion engine on the exhaust-gas line length of the exhaust system according to the invention.

FIG. 2 is a bar chart that shows the dependence of the torque of the internal combustion engine on the exhaust-gas line length of the exhaust system according to the invention. The "exhaust-gas line length" refers, here, to the flow-active distance of the exhaust-gas mixing chamber 6 from the outlet valve of the internal combustion engine. The standardized torque of a V6-engine in the case of low to medium rotational speeds is plotted on the ordinate 20 of the chart. A randomly selected, comparatively short length of the exhaust-gas lines 1, 2 results in a 100%-standardized torque illustrated here by the bar 21. An optimized design of the length of the exhaust-gas lines 1, 2 produces the torque which, by comparison, is increased by about 6%, as shown by the bar 22. This result shows that all the torque or power can be influenced in an advantageous way by the exhaust system according to the invention.

Figure 3:
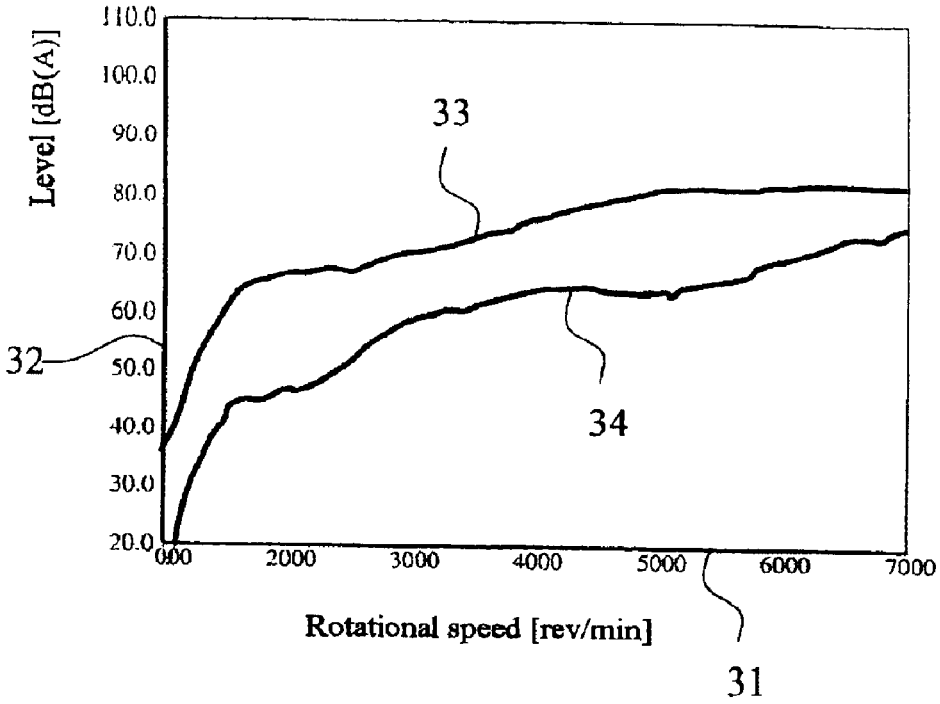
FIG. 3 is a graph which depicts the dependence of the sound level on the rotational speed of the internal combustion engine, for two different exhaust systems.

FIG. 3 is a graph of the sound level of a selected secondary order as a function of the rotational speed of the internal combustion engine for two different exhaust systems. (The internal combustion engine used here was likewise a V6-engine.) The engine rotational speed is plotted in rev/min on the abscissa 31 and the sound level is plotted in dB(A) on the ordinate 32. The curve 33 shows the results for an exhaust system without exhaust-gas mixing chamber 6 (in contrast to the design illustrated in FIG. 1), in which the sound level rises with increasing rotational speed, according to the curve 33. By contrast, a sound level which is lower by about 15 dB(A) is obtained over the entire rotational-speed range for the exhaust system according to the invention with a perforated exhaust-gas mixing chamber 6 according to FIG. 1. The reduction, documented in the graph of FIG. 3, of the sound level of a selected engine secondary order thus shows clearly the effectiveness of the exhaust system according to the invention designed according to FIG. 1.

Figure 4:
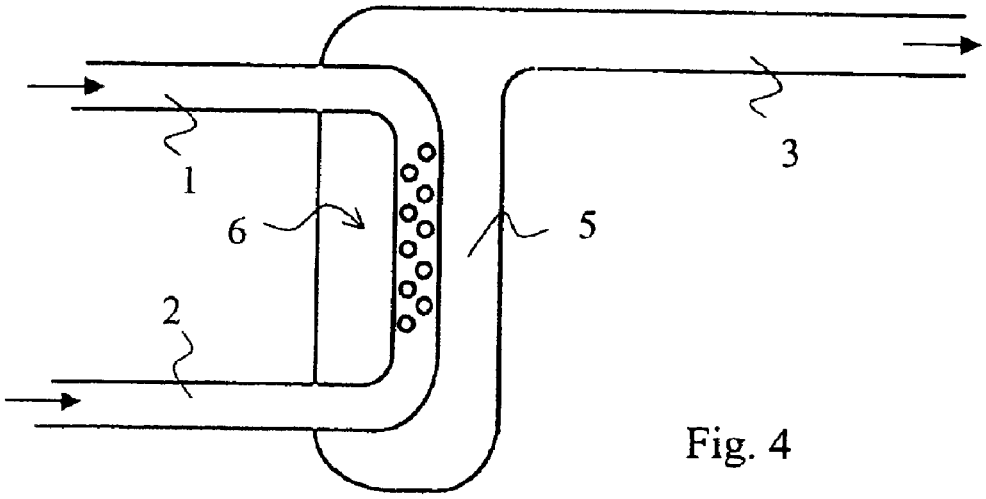
FIG. 4 is a diagram of a second embodiment of the exhaust system according to the invention.

FIG. 4 shows a further preferred embodiment of the exhaust system according to the invention, in which the individual structural elements, insofar as they are identical to elements of FIG. 1, are identified by the same reference symbols. In contrast to the embodiment illustrated in FIG. 1, the exhaust-gas outlet from the exhaust-gas expansion chamber 5 is of single-flow design. Thus, the exhaust-gas expansion chamber 5 is designed as a silencer, with a direct transition into a single exhaust-gas outlet line 3. In a manner similar to the embodiment illustrated in FIG. 1, exhaust gas from two cylinder groups of an internal combustion engine is combined, via the exhaust-gas lines 1, 2, in the perforated exhaust-gas mixing chamber 6 arranged in the exhaust-gas expansion chamber 5. As compared with a double-flow exhaust-gas outlet, one exhaust-gas outlet line becomes unnecessary and a high degree of flexibility with regard to the line routing is achieved.

Figure 5:
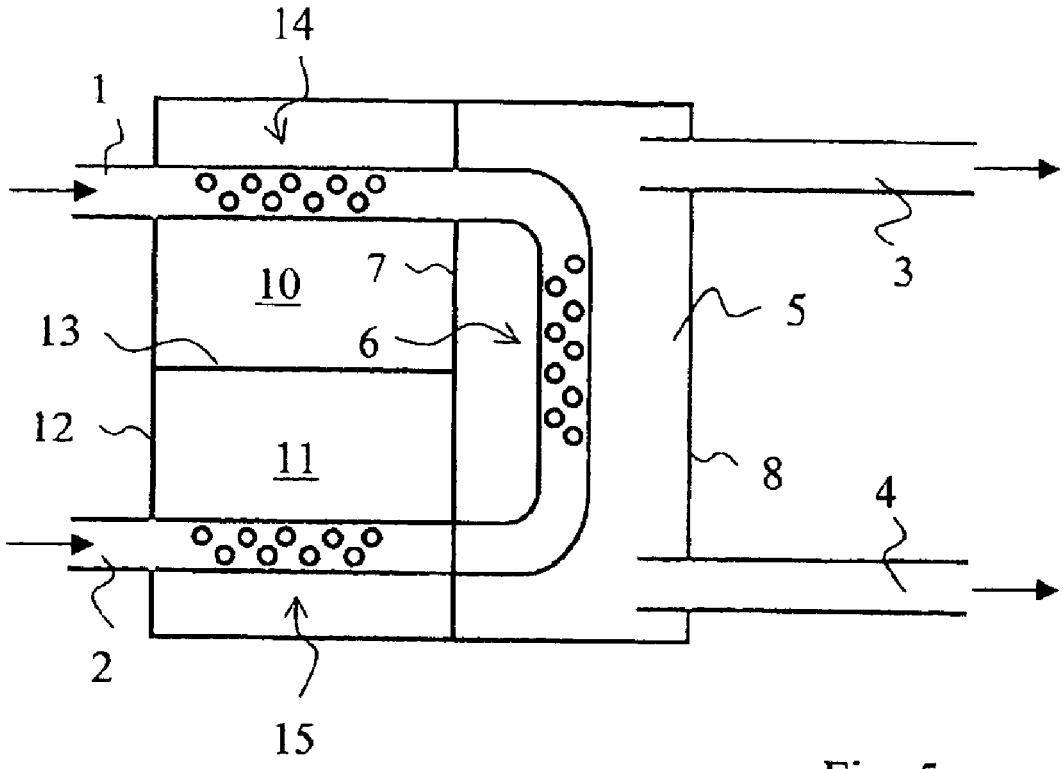
FIG. 5 is a diagram of a third embodiment of the exhaust system according to the invention.

FIG. 5 shows a further embodiment of the exhaust system according to the invention, in which individual structural elements that are identical to those of FIG. 1 are identified by the same reference symbols. In contrast to the embodiment illustrated in FIG. 1, the exhaust-gas lines 1, 2 are led through a housing 10, 11, upstream of the point where they are combined in the exhaust-gas mixing chamber 6 arranged in the exhaust-gas expansion chamber 5. The exhaust-gas lines 1, 2 are led through a common side wall 12 into the interior of the housings 10, 11, which are substantially gas-tight outwardly and are separated from one another by means of a gas-tight partition 13. At the same time, they have a further partition 7 common with the downstream, adjacent expansion chamber. The exhaust-gas lines are led through this partition 7 into the exhaust-gas expansion chamber 5 in substantially gas-tight manner similar to the embodiment illustrated in FIG. 1.

Within the housing 10, 11, the respective exhaust-gas lines 1,2 have perforated portions 14,15. The housings 10 and 11 act as compensating volumes with respect to gas pulsations or pressure oscillations in the exhaust-gas lines 1 and 2, which can be broken down via the perforated portions 14 and 15, further improving noise-damping. The housings 10, 11 with the perforated exhaust-gas line portions 14, 15 form a silencer within the exhaust system.

In a similar manner, the housings 10, 11 may also be arranged downstream of the exhaust-gas expansion chamber 5, directly adjacent to one another or separately, and against the exhaust-gas expansion chamber 5 or separate from it. In this case, the exhaust-gas outlet lines 3, 4 are led through the housings 10, 11, and each has a perforated line portion within the housings 10, 11.

Figure 6:
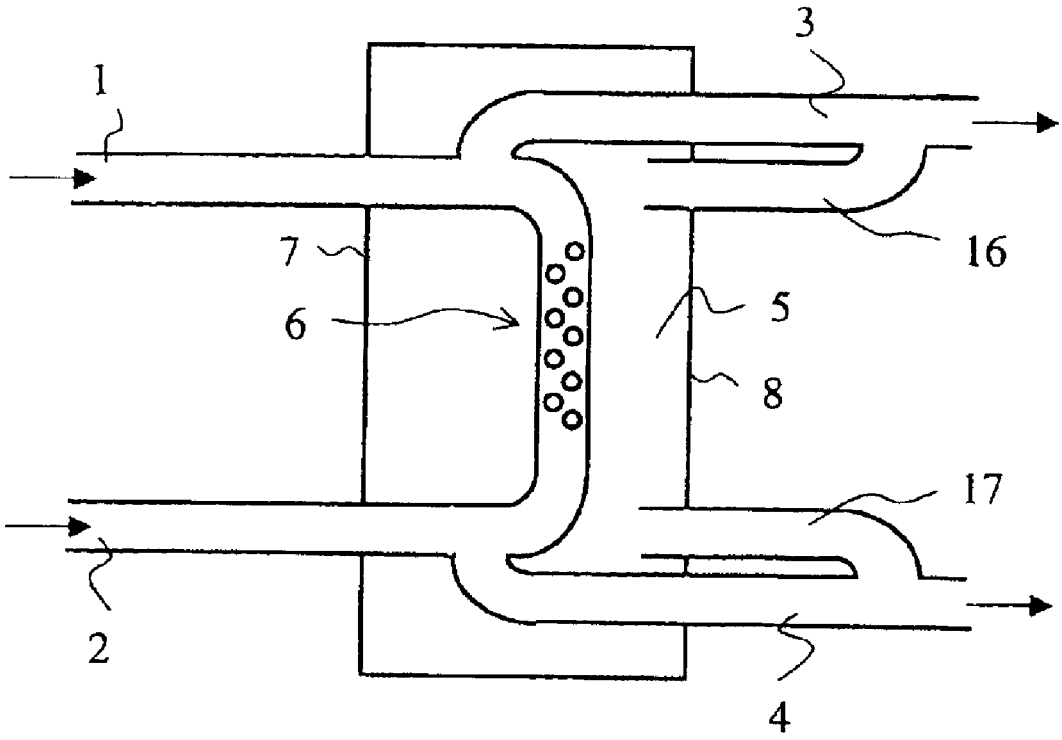
FIG. 6 is a diagram of a fourth embodiment of the exhaust system according to the invention.

FIG. 6 illustrates a further embodiment of the exhaust system according to the invention, in which individual structural elements that are identical to parts of FIG. 1 are identified by the same reference symbols. Here again, the exhaust-gas outlet line is of the double-flow design with a first exhaust-gas outlet line 3 and a second exhaust-gas outlet line 4. In contrast to the embodiments illustrated in FIG. 1 and FIG. 5, however, the first exhaust-gas outlet line 3 is combined, upstream of the perforated exhaust-gas mixing chamber 6, with the first exhaust-gas line 1, and in the same way, the second exhaust-gas outlet line 4 is combined, upstream of the perforated exhaust-gas mixing chamber 6, with the second exhaust-gas line 2. In the particularly preferred design illustrated here, the first exhaust-gas outlet line 3 has a branch 16 outside the exhaust-gas expansion chamber 5 and downstream of the point where the first exhaust-gas outlet line is combined with the first exhaust-gas line 1 which is likewise led through the wall 8 into the exhaust-gas expansion chamber 5. In the same way, the second exhaust-gas outlet line 4 has a branch 17 outside the exhaust-gas expansion chamber 5 and downstream of the point where the second exhaust-gas outlet line is combined with the second exhaust-gas line 2 which is led into the exhaust-gas expansion chamber 5. The branches 16, 17 of the exhaust-gas outlet lines in each case terminate with an opening, into the exhaust-gas expansion chamber 5; and, due to the perforation in the exhaust-gas mixing chamber 6, they can receive exhaust gas expanded into the exhaust-gas expansion chamber and supply it to the exhaust-gas outlet lines 3, 4. By virtue of this embodiment, specific engine secondary orders can be effectively damped, and therefore the exhaust-gas noise can be influenced.

Figure 7:
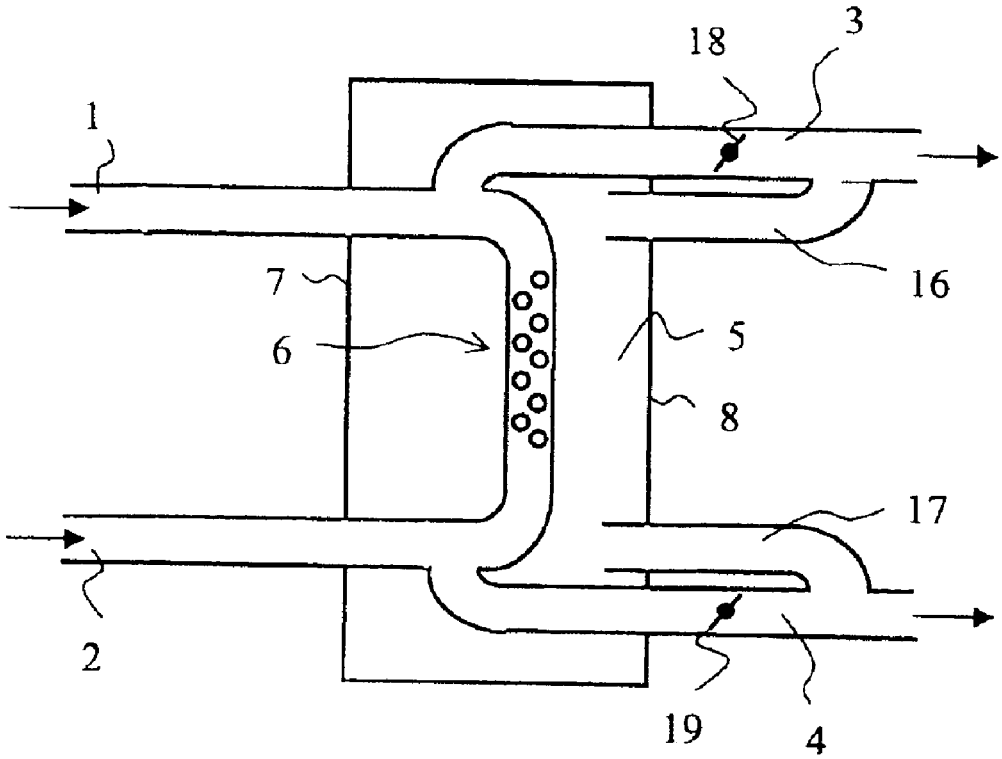
FIG. 7 is a diagram of a fifth embodiment of the exhaust system according to the invention.

The further embodiment illustrated in FIG. 7 differs from that of FIG. 6 in the adjustable throttle elements 18, 19 which are arranged in the exhaust-gas outlet lines 3, 4, downstream of the point where the latter are combined with the exhaust-gas lines 1, 2 and upstream of the branches 16, 17. By controlled adjustment of the throttle elements 18, 19 (designed, for example, as flaps), the acoustic effectiveness of the exhaust-gas mixing chamber 6 and the counterpressure of the exhaust system can be influenced.

Figure 8:
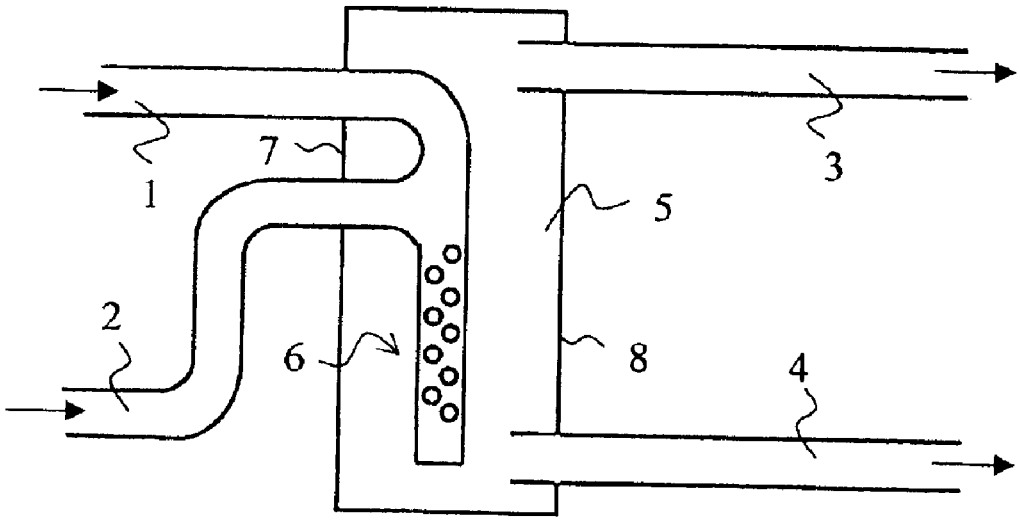
FIG. 8 is a diagram of a sixth embodiment of the exhaust system according to the invention.

FIG. 8 illustrates a further embodiment of the exhaust system according to the invention, in which individual structural elements that are identical to parts of FIG. 1 are identified by the same reference symbols. In contrast to the embodiment of FIG. 1, the exhaust-gas lines 1, 2 issue, within the exhaust-gas expansion chamber 5, next to one another, at the same end, into the exhaust-gas mixing chamber 6. The perforation of the exhaust-gas mixing chamber 6 is therefore not formed between the issues of the exhaust-gas lines 1, 2, but, instead, in a portion of the exhaust-gas mixing chamber which points away from the issues. In the embodiment illustrated here, the exhaust-gas mixing chamber 6 extends away from the issues of the exhaust-gas lines 1, 2 approximately at right angles. It is also possible to orient the exhaust-gas mixing chamber 6 approximately in the direction of the exhaust gases flowing out of the exhaust-gas lines 1, 2 into the exhaust-gas mixing chamber 6. In this case, the points of connection of the exhaust-gas mixing chamber 6 to the exhaust-gas lines 1, 2 is designed in the manner of bifurcated pipe. The exhaust-gas mixing chamber 6 is preferably closed at the end facing away from the issues of the exhaust-gas lines 1, 2. In addition to the hitherto mentioned interactions between the exhaust-gas streams combined in the exhaust-gas mixing chamber 6, this embodiment results in reflections at the closed end.

It goes without saying that, for a further improvement in sound insulation, the chamber in each case surrounding a perforated line portion and also all the other line elements may be clad with noise-damping material or may contain such a material.

The foregoing disclosure has been set forth merely to illustrate invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An exhaust system for a multi-cylinder internal combustion engine, said exhaust system comprising:

a first exhaust-gas line for receiving exhaust gas from a first cylinder group of the internal combustion engine;

a second exhaust-gas line for receiving exhaust gas from a second cylinder group of the internal combustion engine;

an exhaust-gas expansion chamber; and an exhaust-gas outlet line, leading out of the exhaust-gas expansion chamber, for the discharge of exhaust gas; wherein, the first exhaust-gas line and the second exhaust-gas line are lead into an at least partially perforated exhaust-gas mixing chamber;

the exhaust-gas expansion chamber is coupled in gas flow communication with the exhaust-gas mixing chamber via the perforation of the exhaust-gas mixing chamber, so that exhaust gas can expand out of the exhaust-gas mixing chamber into the exhaust-gas expansion chamber; and the first and second exhaust-gas lines and the exhaust-gas mixing chamber collectively comprise a single continuous length of tubing, with the exhaust-gas mixing chamber being formed by an intermediate portion of said tubing which connects said first exhaust-gas line with said second exhaust as line.

2. The exhaust system according to claim 1, wherein the exhaust-gas mixing chamber is arranged directly adjacently to the exhaust-gas expansion chamber.

3. The exhaust system according to claim 1, wherein the exhaust-gas mixing chamber is arranged in the exhaust-gas expansion chamber.

4. The exhaust system according to claim 1, wherein the exhaust-gas mixing chamber has a perforation designed uniformly all-round.

5. The exhaust system according to claim 1, further comprising movable means for selectively closing a variable portion of the perforations in the exhaust-gas mixing chamber.

6. The exhaust system according to claim 5, wherein said movable means comprise a sleeve which is displaceable along an exterior of said exhaust-gas mixing chamber.

7. An exhaust system for a multi-cylinder internal combustion engine, said exhaust system comprising:

a first exhaust-gas line for receiving exhaust gas from a first cylinder group of the internal combustion engine;

a second exhaust-gas line for receiving exhaust gas from a second cylinder group of the internal combustion engine;

an exhaust-gas expansion chamber; and an exhaust-gas outlet line, leading out of the exhaust-gas expansion chamber, for the discharge of exhaust gas; wherein, the first exhaust-gas line and the second exhaust-gas line are lead into an at least partially perforated exhaust-gas mixing chamber;

the exhaust-gas expansion chamber is chamber in gas flow communication with the exhaust-gas mixing chamber via the perforation of the exhaust-gas mixing chamber, so that exhaust gas can expand out of the exhaust-gas mixing chamber into the exhaust-gas expansion chamber; and the exhaust-gas outlet line is connected with a line that branches off from at least one of the first exhaust-gas line and the second exhaust-gas line, upstream of the exhaust-gas mixing chamber.

8. An exhaust system for a multi-cylinder internal combustion engine, said exhaust system comprising:

a first exhaust-gas line for receiving exhaust as from a first cylinder group of the internal combustion engine;

a second exhaust-gas line for receiving exhaust gas from a second cylinder group of the internal combustion engine;

an exhaust-gas expansion chamber; and an exhaust-gas outlet line, leading out of the exhaust-gas expansion chamber, for the discharge of exhaust gas; wherein, the first exhaust-gas line and the second exhaust-gas line are lead into an at least partially perforated exhaust-gas mixing chamber;

the exhaust-gas expansion chamber is coupled in gas flow communication with the exhaust-gas mixing chamber via the perforation of the exhaust-gas mixing chamber, so that exhaust gas can expand out of the exhaust-gas mixing chamber into the exhaust-gas expansion chamber; and at least one of the first exhaust-gas line and the second exhaust-gas line and an exhaust-gas outlet line has, outside the exhaust-gas expansion chamber, a perforated portion led through a housing.

9. An exhaust system for a multi-cylinder internal combustion engine, said exhaust system comprising:

a first exhaust-gas line for receiving exhaust gas from a first cylinder group of the internal combustion engine;

a second exhaust-gas line for receiving exhaust gas from a second cylinder group of the internal combustion engine;

an exhaust-gas expansion chamber; and an exhaust-gas outlet line, leading out of the exhaust-gas expansion chamber, for the discharge of exhaust gas; wherein, the first exhaust-gas line and the second exhaust-gas line are lead into an at least partially perforated exhaust-gas mixing chamber;

the exhaust-gas expansion chamber is coupled in gas flow communication with the exhaust-gas mixing chamber via the perforation of the exhaust-gas mixing chamber, so that exhaust as can expand out of the exhaust-gas mixing chamber into the exhaust-gas expansion chamber; and a closing means for closing a predeterminable part of the perforation of the exhaust-gas mixing chamber is provided.

10. An exhaust system for a multi-cylinder internal combustion engine, said exhaust system comprising:

a first exhaust-gas line for receiving exhaust gas from a first cylinder group of the internal combustion engine;

a second exhaust-gas line for receiving exhaust gas from a second cylinder group of the internal combustion engine;

an exhaust-gas expansion chamber; and an exhaust-gas outlet line, leading out of the exhaust-gas expansion chamber, for the discharge of exhaust gas; wherein, the first exhaust-gas line and the second exhaust-gas line are lead into an at least partially perforated exhaust-gas mixing chamber;

the exhaust-gas expansion chamber is coupled in gas flow communication with the exhaust-gas mixing chamber via the perforation of the exhaust-gas mixing chamber, so that exhaust gas can expand out of the exhaust-gas mixing chamber into the exhaust-gas expansion chamber; and said first and second exhaust-gas lines collectively comprise a single continuous length of tubing, with the exhaust-gas mixing chamber being formed by a second length of tubing which is connected at one extremity thereof to the continuous length of tubing at an intermediate point of said continuous length of tubing, with said perforations being formed along peripheral sides of said second length of tubing.

11. The exhaust system according to claim 10, wherein the exhaust-gas mixing chamber is arranged directly adjacently to the exhaust-gas expansion chamber.

12. The exhaust system according to claim 10, wherein the exhaust-gas mixing chamber is arranged in the exhaust-gas expansion chamber.

13. The exhaust system according to claim 10, wherein the exhaust-gas mixing chamber has a perforation designed uniformly all-round.

* * * * *